US006957467B2

(12) United States Patent
Cabedo-Deslierres et al.

(10) Patent No.: US 6,957,467 B2
(45) Date of Patent: Oct. 25, 2005

(54) TRIPLE CLEAN TOOTHBRUSH

(76) Inventors: Maria R. Cabedo-Deslierres, 2337 E. Brookdale Pl., Fullerton, CA (US) 92831; John M. Deslierres, 2337 E. Brookdale Pl., Fullerton, CA (US) 92831

( * ) Notice: Subject to any disclaimer, the term of this patent is extended or adjusted under 35 U.S.C. 154(b) by 337 days.

(21) Appl. No.: 09/877,645

(22) Filed: Jun. 9, 2001

(65) Prior Publication Data

US 2001/0054211 A1 Dec. 27, 2001

Related U.S. Application Data

(60) Provisional application No. 60/237,078, filed on Sep. 30, 2000, and provisional application No. 60/210,238, filed on Jun. 8, 2000.

(51) Int. Cl.[7] ..... A46B 9/04

(52) U.S. Cl. ..... 15/106; 15/167.1; 15/110; 15/111; 132/328

(58) Field of Search ..... 15/106, 110, 111, 15/167.1, 184, 185; 132/308, 309, 310, 311, 328; 601/141

(56) References Cited

U.S. PATENT DOCUMENTS 1,487,075 A * 3/1924 Olson et al. ..... 132/309
5,046,212 A * 9/1991 O'Conke ..... 15/105
5,058,230 A 10/1991 Hodosh et al. ..... 15/167.1
5,097,852 A * 3/1992 Wu ..... 132/309
5,511,276 A 4/1996 Lee ..... 15/167.1
5,934,295 A 8/1999 Gekhter et al. ..... 132/309

* cited by examiner

*Primary Examiner*—Robert J. Warden, Sr.
*Assistant Examiner*—S Balsis

(57) ABSTRACT

A toothbrush that provides, besides the conventional bristles for brushing the teeth, other basic periodontal components recommended by dentists for perfect cleaning, massaging and stimulating the gum tissue, all in one single, convenient artifact. The brush component is molded into one end of the handle, in conventional manner, and the opposite end of the handle contains two parallel cylinders for housing the two periodontal tools which are extended and retracted with buttons, one on each side of the handle, through a slit in each cylinder wall, establishing a means for this movement. The buttons engage two sliders, the ends of each hold extension tubes that capture and retain the dental tools and provide replacement capabililty. Each cylinder contains a hinged close-out cover for protection of the periodontal tools from contamination and loss of the cover.

1 Claim, 1 Drawing Sheet

TRIPLE CLEAN TOOTHBRUSH

This application claims benefit of Provisional patent Ser. No. 60/210,238 filed Jun. 8, 2000 and Provisional patent Ser. No. 60/237,078 filed on Sep. 30, 2000.

BACKGROUND OF THE INVENTION

This invention relates to a toothbrush that also comprises two other dental hygiene accessories such as a small interdental hardbrush and a rubber cone shaped periodontal gum massager and stimulator, ready for use as part of the same artifact.

In the field of dental hygiene, the dentists have available a multiplicity of tools and brushes that they use for cleaning the teeth, massaging the gums and preventing periodontal diseases. The dentists recommend that in addition to brush cleaning the teeth with a conventional toothbrush, every person should as frequently as possible, individually, massage and stimulate the gums to firm the gum tissue and prevent periodontal disease. To achieve this effect, a rubber pointed cone shaped massager and stimulator tip, small enough for insection into and between two teeth, at the gum line, should be used. On insertion between the teeth, the user applies light pressure to the rubber tip so that, besides acting like a toothpick, dislodging from the little spaces any possible minuscule particle, with a circular motion, it will also massage and stimulate the gums. Until now, the said rubber tip has been generally attached at right angles to the end of a special tool, to a separate small diameter bent tubular tool, or molded firmly on and projecting from the end of a toothbrush.

Dentists recommend also to brush the curved faces of the teeth where they interface with the gums, and so a small compact interdental hard brush should be used to fit in the pocket space formed by the gum and two adjacent teeth. By moving this small hard brush in and out, and side to side, it cleans the portions of the teeth generally not reached by a conventional toothbrush.

In fact, these unrelated operations require, besides the conventional toothbrush, two different tools to efficiently accomplish the perfect tooth brushing and lateral cleaning as well as gum massage functions. All the three tools, if separate, are difficult to handle, package, carry around and are independently vulnerable to loss, damage, contamination, never seem to be available when needed, and are very inconvenient for separate storage and accessability.

All of the heretofor known toothbrushes that contain a rubber gum massager and stimulator tip attached to the end of the handle suffer from a number of disadvantages:

(a) when said gum massager and stimulator tip is positioned on the end of the handle, it projects outwardly normal to the flat of the handle, and when the toothbrush user grabs the handle, the rubber point bent over and can become damaged;

(b) the said gum massager and stimulator tip on the end of the handle can become contaminated by the hand of the user when he (or she) handles the toothbrush and his (or her) hand overlaps the projecting rubber point;

(c) the said gum massage stimulator tip molded onto the handle cannot be removed or replaced if needed, should the rubber point becomes broken or worn by the hands of the user;

(d) when after brushing, the said toothbrush ending projecting gum massager and stimulator tip is put away and is not thoroughly covered or wrapped, it can become disclored, dirty or contaminated from exposure to the surrounding where it was retained in. This contamination, then, is transferred to the gums by the user.

To accommodate the many dental requirements for tools to meet diverse dental situations, prior art has developed a series of systems and arrangements that add and exchange dental tool heads to a variety of handles. This exchange operation requires the user to store, provide access to, and spend time applying and removing the various components during his (or her) toothbrush operation. Such loose components can easily be misplaced, lost, contaminated or just not used because they are not readily available in the time needed to perform at least twice daily the complete tooth and gum hygiene requirement.

For example, U.S. Pat. No. 5,058,230, Milton Hodosh et all, presents a cheap handle with a removable head. There is little or no need to have loose components that must be stored, protected, found and applied for each toothbrush operation on a regular basis. Every component must be readily available or it will not be used . Likewise, U.S. Pat. No. 5,511,276 Kuo-Ming Lee, presents a removable brush head and a latching assembly to lock to the handle. Again, the brush head is a loose component that latches in and out of the handle.

U.S. Pat. No. 5,934,295 Vladam Gekhter et al, also presents a patent that contains a handle with a multiplicity of removable brushes and tool components that require storage and must be made available for ready use by the toothbrush user. This configuration provides the dentist with considerable options when addressing tooth problems in a dentist office, but is not the type of tool that encourages ready, constant, scheduled, dedicated everyday individual user to spend needed time and deligence on his (or her) dental hygiene requirements. To encourage good dental practices, the required tools must be on hand, ready for immediate use, and not inside a box or in a drawer, forgotten or overlooked.

The uniqueness of the present ready to use triple-clean effect toothbrush does not infringe on either of the above referred to Patents.

BRIEF SUMMARY OF THE INVENTION

This invention provides a means for combining the brushing cleaning function with the gum massage function and the much needed interdental brush function, all in one tool. In order to achieve the triple clean effect of this toothbrush, the body of the tool contains at one end the brush with the bristles clustered in groups to provide an efficient pattern to fully bush the teeth externally, in a conventional manner. These bristles are captured in the end of the toothbrush body, in an elongated pattern, and are firmly molded into the material. In this invention the toothbrush body contains a means for providing a gum massage stimulator tip and a small interdental hard brush in the same toothbrush body, for ready use by the user. This is achieved by internal hollow spaces in the toothbrush body that form the handle, and a portion of the toothbrush body that holds the bristles. This unique arrangement holds together all three components of a triple-clean tool, thus providing tooth brushing, interdental clean-and-rush functions, as well as gum massaging, all in one handy toothbrush.

Presently, and because it has been found that a separate tool for each function has caused inconvenience for storage and availability, there are several objects and advantages of this invention when creating a single triple-clean toothbrush:

(a) the three necessary teeth and gum brushing cleaning and massaging functions are combined in one single tool;

(b) the three tools are readily available to the user, (c) the three tools are positioned in such way that each of them will not be mishandled and contaminated by the user while he (she) is using any of the other two tools;

(d) the interdental hard brush and the gum massager and stimulator tip are protected from damage by being incased in the toothbrush;

(e) there is a need to have all three functions readily available when people are brushing their teeth and, at the same time, taking care of the gums, following every dentist's instructions for perfect oral hygiene.

DETAILED DESCRIPTION OF THE INVENTION

This invention provides a means for combining the tooth brushing cleaning function with the gum massage and stimulation function and the much needed interdental brush function, all in one tool.

Figure 1:
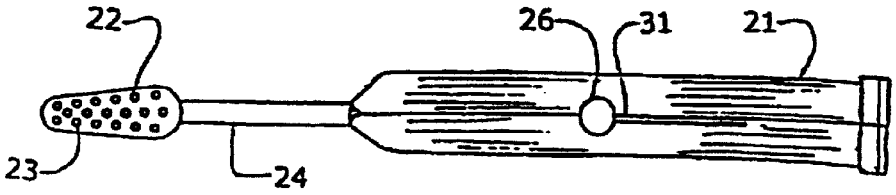
FIG. 1 shows the toothbrush with the interdental hard brush and gum massager and stimulator tip installed inside the hollow chamber of the parallel cylinders in the handle, retracted.

The assemblage of the present invention is illustrated in FIG. 1, plan view, with the interdental hard brush and gum massage stimulator tip retracted in the end of the toothbrush.

Figure 2:
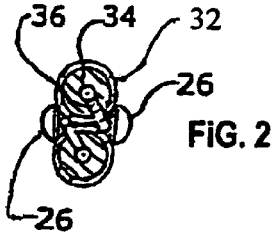
FIG. 2 shows a cross section through the two hollow cylinders that comprise
Figure 3:
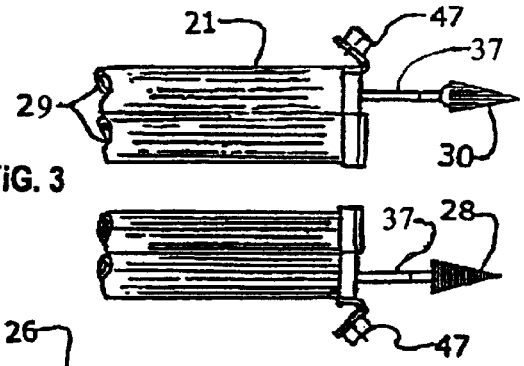
FIG. 3 shows the toothbrush with the interdental hard brush and gum massager and stimulator tip extended from the parallel hollow cylinders.

In order to achieve the triple clean effect of this toothbrush, FIG. 1 shows the toothbrush and its double parallel cylindrical handle containing at one end the bristles (23) of the brush (22), clustered in groups, to provide the common pattern to fully brush the teeth externally, in a conventional manner. Inside the toothbrush handle, as shown in FIGS. 2 & 3, there are two parallel cylindrical recess chambers (29) that run the fill length of the handle. In addition, the handle neck is narrow (24) and slim for a short distance from the brush end up to the area where the user holds the said handle. At the point where the user holds the toothbrush, the handle is widened out to provide a wider and firmer grip for grasping it, and contains recessed into this, grip area the hollow recess chambers (29) that hold sliding buttons (26) that are keyed (36) to sliders (34) that slide back and forth on the inside of the recess chambers inside the handle. Attached to the end of the sliders there are extension tubes (37) that hold the interdental hard brush (28) and the gum massager stimulator tip (30) for brushing in the gaps and spaces between the teeth, massaging the gums.

The sliding buttons (26) can be moved horizontally in slots (31) that control their travel distance, in either direction Movement in one direction of the buttons (26) keyed (36) to sliders (34) that have internal sliding extension tubes (37), each independently extends out of the end of the toothbrush handle one of the periodontal tools, and movement in the opposite direction retracts that periodontal tool into its recess chamber inside the toothbrush handle. In like manner, FIGS. 2 & 3 show the opposite end of the toothbrush containing two identical sliding buttons (26), sliding extension tubes (37), keys (36), and a slider (34) in the long recess chamber (29) within the handle section of the toothbrush.

FIG. 3 shows the close-out covers (47) hinged to the cylinder ends to seal them, avoiding loss as well as contamination of the periodontal tools while they are not in use.

Figure 4:
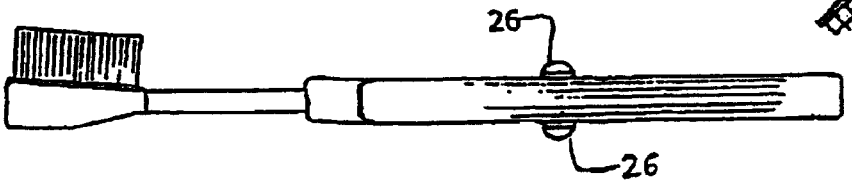
FIG. 4 shows the side view of the toothbrush with the gum massage stimulator tip and interdental hard brush retraced.
Figure 5:
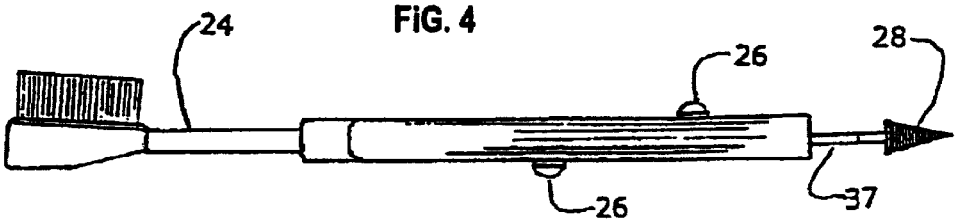
FIG. 5 shows a side view and a cross section of one of the parallel hollow cylinders with an extension tube that extends and retracts the interdental hard brush with a traveling slider.
Figure 6:
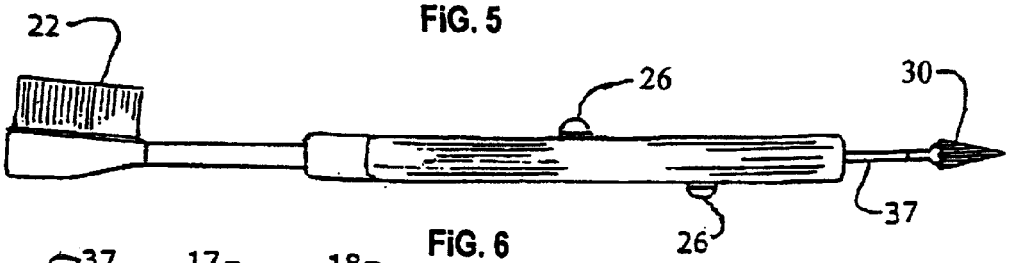
FIG. 6 shows an esternal side view of the complete toothbrush.

FIG. 4 shows, in a side view, both the gum massager stimulator tip and the interdental hard brush retracted into the toothbrush. All three are held firmly in the same tool and readily available for addressing each tooth cleaning function as needed, in any cleaning order, at the user discretion FIG. 5 shows the interdental hardbrush extended, and FIG. 6 shows the gum massager extended.

Figure 6B:
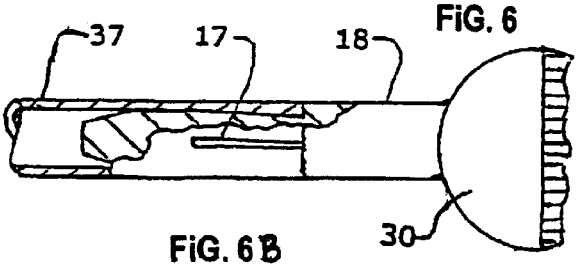
FIG. 6B shows an enlarged view of the engagement of the interdental hard brush and the gum massager and stimulator tip, with the internal extension tube.
Figure 6A:
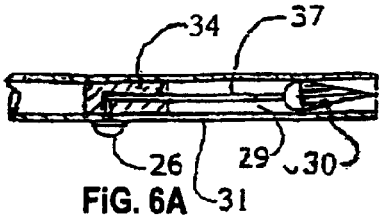
FIG. 6A shows a cross section of the toothbrush with the button that moves the gum massager and stimulator tip in and out of the hollow space of one of the cylinders.

FIG. 6A provides a cross section view of a recess chamber. Each button travels the length of the slot (31) and thus the slider (34) moves from one end of the slot to other end of the slot, extending the extension tube with the periodontal tool out of the end of each cylinder. The ends of the internal sliding extension tubes (37) are made to accept at either end the said gum massager stimulator tip (30) or the interdental hard brush (28) or any other priodontal tool, should they be required. Both the gum massager stimulator tip (30) and the interdental hard brush (28) can be replaced as needed. The respective sliding extension tubes (37) have replacement capability.

FIG. 6B shows an enlarged view of the capability of assemblage and/or replacement of the periodontal tools: each extension tube (37) contains a slit (17) down one side, or two sides if needed, to permit the tube to be expanded in diameter and allow insertion of the periodontal tool stem (18) to be inserted and forceably pressed into the extension tube. The slit in the tube side walls capture and holds the stem (18) of the periodontal tool, by deflection of the slit tube side walls. The stem is slightly reduced in diameter where the sliding tube side walls grasp the stem and capture it. The stem contains minor indentations to impede and retard easy removal from the slit extension tubes and the inner wall of the extension tubes is course machined to increase the resistance of component accidental removal.

Although the description above contains many specificities, these should not be construed as limiting the scope of the invention, but as merely providing illustrations of some of the presently preferred embodiment of this invention. Thus, the scope of the invention should be determined by the appended claims covering any modifications that may be made therein and fall within its spirit.

We claim:

1. A toothbrush providing multiple replaceable dental tools in one assemblage comprising:

(a) a brush handle and an integrally formed brush head at one end of said handle, said brush head including a plurality of bristles for brushing teeth, said brush handle including two parallel hollow cylindrical tubes for grasping said toothbrush, wherein said tubes each comprise an internal recess chamber for holding and guiding an interdental hard brush, a periodontal gum massager stimulator tip, or any other combination of periodontal tools as they extend for use and retract for protection while not in use; and (b) a cylindrically shaped slider located within each cylindrical tube that slides within said recess chamber, and (c) an extension tube comprising a first and second end wherein said second end of extension tube is removably received within said slider, said first end of extension tube can removably hold and retain an interdental hard brush, a periodontal gum massager stimulator tip, or any other combination of periodontal tools, and (d) a slot extending through a wall of each cylindrical tube, and (e) a button partially extending through each slot, wherein a part of said button is attached to each slider inside said cylindrical tube and a part of said button can be moved horizontally by finger movement outside said cylindrical tube; and wherein said slots in the wall of said cylindrical tube control and guide the movement of said buttons, and define the travel length of said buttons and said sliders; and wherein said extension tubes that are attached to said sliders can extend out of an open end of said recess chamber a distance equivalent to the length of said slots in said cylindrical tubes; and (f) a hinged close-out cover attached to said open end of each recess chamber to inhibit and prevent contamination from entering while said periodontal tools are not in use.

* * * * *